United States Patent [19]

Baba et al.

[11] Patent Number: 5,049,475

[45] Date of Patent: Sep. 17, 1991

[54] METHOD FOR PRODUCTION OF PHOTOSENSITIVE MATERIAL FOR DIFFUSION TRANSFER PROCESS

[75] Inventors: Susumu Baba; Akio Yoshida; Yasuo Tsubai, all of Nagaokakyo, Japan

[73] Assignee: Mitsubishi Paper Mills Limited, Tokyo, Japan

[21] Appl. No.: 437,632

[22] Filed: Nov. 17, 1989

[30] Foreign Application Priority Data

Jun. 16, 1989 [JP] Japan ..... 1-153789

[51] Int. Cl.[5] ..... G03C 5/54

[52] U.S. Cl. ..... 430/249; 430/227; 430/230; 430/244; 430/234

[58] Field of Search ..... 430/204, 206, 227, 230, 430/244, 249, 234

[56] References Cited

U.S. PATENT DOCUMENTS

| | | | |
|---|---|---|---|
| 2,834,676 | 5/1958 | Stanley et al. | 430/244 |
| 2,962,377 | 11/1960 | Land | 430/244 |
| 3,300,306 | 1/1967 | Sevens et al. | 430/204 |
| 4,302,526 | 11/1981 | Kohmura et al. | 430/230 |
| 4,562,140 | 12/1985 | Kohmura et al. | 430/230 |
| 4,606,985 | 8/1986 | Takaya et al. | 430/204 |
| 4,632,896 | 12/1986 | Tsabai et al. | 430/249 |
| 4,743,525 | 5/1988 | Yamamoto et al. | 430/204 |
| 4,824,760 | 4/1989 | Yamamoto et al. | 430/204 |
| 4,873,170 | 10/1989 | Nishinoiri et al. | 430/204 |

*Primary Examiner*—Richard L. Schilling

*Attorney, Agent, or Firm*—Cushman, Darby & Cushman

[57] ABSTRACT

A photosensitive material for diffusion transfer process is disclosed according to which characteristic such as high maximum density, high contrast and image reproducibility can be stably obtained. This photosensitive material comprises a support and, provided thereon, a silver halide emulsion layer and a hydrophilic colloid layer and which is processed in contact with an image receiving material in a processing solution for silver complex diffusion transfer process wherein at least one of the silver halide emulsion layer and the hydrophillic colloid layer permeable to water contains a hydroxybenzene developing agent; when the layers on the emulsion layer coated side are immersed in a 0.1N aqueous sodium hydroxide solution at 20° C. for 1 minute, amount of solution absorbed in the layers is 3.5–7.0 ml per 1 g of hydrophilic colloid; and the support comprises a paper coated with polyolefin resin on both sides and has a water content of 5.5%–7.5%.

7 Claims, No Drawings

METHOD FOR PRODUCTION OF PHOTOSENSITIVE MATERIAL FOR DIFFUSION TRANSFER PROCESS

BACKGROUND OF THE INVENTION

The present invention relates to a material for silver complex diffusion transfer process and in particular to a negative material for silver complex diffusion transfer development.

In silver complex diffusion transfer process, in general a negative material comprising a support and a silver halide emulsion layer coated thereon, a positive material comprising a support and an image receiving layer containing physical development nuclei coated thereon and a processing solution containing a silver halide solvent are used.

That is, silver halide of exposed portion of exposed negative material is developed with a developing agent in the processing solution or the negative material (chemical development) and simultaneously silver halide of unexposed portion reacts with silver halide solvent to become a soluble silver complex salt, which diffuses into the positive material and is deposited at physical development nuclei of positive material (image receiving material) to form a silver image. In silver complex diffusion transfer process of this type, qualities of finally obtained image such as image density, color tone of image, contrast of image and storage stability of the obtained reproduced copy are important. A continuous tone original is reproduced on image receiving material for some uses, but higher contrast, sharpness and resolving power are required for using as a block copy for reproduction of documents, printed matter or for plate making. Furthermore, in the recent silver complex diffusion transfer development for higher transfer efficiency, namely, for completion of transfer in 5-15 seconds, it is necessary to obtain sufficient transfer density in a short time.

In one embodiment for carrying out silver complex diffusion transfer process as disclosed in British Patent Nos. 1,000,115, 1,012,476, 1,017,273 and 1,042,477, photosensitive silver halide emulsion layer or image receiving layer contains developing agent and hence processing solution used in development stage contains substantially no developing agent, namely, so-called alkali activation solution is used.

When such processing solution is used, the developing agent contained in the material must be contained in a large amount enough to be able to sufficiently develop exposed and unexposed silver halide.

U.S. Pat. No. 4,032,526 discloses to provide a photosensitive material for silver complex diffusion transfer which contains stably a large amount of developing agent by providing an antihalation undercoat layer containing a hydroxybenzene developing agent such as hydroquinone and a silver halide emulsion layer on a paper support coated with polyolefin resin on both sides with amount of hydrophilic colloid in the undercoat layer being larger than that in the emulsion layer.

Such photosensitive material for diffusion transfer process containing a developing agent is desired to be superior in permeability to alkali activated solution because chemical development in silver halide emulsion layer and physical development caused by diffusion of the developing agent in image receiving layer of positive material must proceed simultaneously. However, hydrophilic colloid (mainly gelation) undergoes change in properties due to the developing agent to inhibit hardening of hydrophilic colloid layer with hardener, resulting in the following defects: Permeability to alkali activated solution becomes too high and image reproducibility is deteriorated; If amount of hardener is increased for solving this problem, viscosity of coating solution increases or hardening gradually proceeds with lapse of time in storage of photosensitive material, and thus this results in reduction of maximum transfer density or reduction of contrast of image in running processing, namely, in processing with exausted alkali activation solution.

As attempt to improve the running processability, U.S. Pat. No. 4,632,896 has proposed a processing solution, but improvement in photosensitive material is also further required.

SUMMARY OF THE INVENTION

An object of the present invention is to provide a photosensitive material for diffusion transfer process which can afford stably the characteristics such as a high maximum density, a high contrast and a high image reproducibility with use of either a fresh processing solution just after preparation or an exhausted processing solution even after long term storage of the photosensitive material which contains hydroxybenzene developing agent.

Other objects of the present invention will be clear from the following disclosures.

The above objects have been attained by providing a photosensitive material for diffusion transfer process which is subjected to processing in contact with an image receiving material in a silver complex diffusion transfer processing solution, characterized in that at least one of silver halide emulsion layer and hydrophilic colloid layer which are permeable to water on a support contains a hydroxybenzene developing agent; when the emulsion layer coated side is immersed in a 0.1N aqueous sodium hydroxide solution at 20° C. for 1 minute, amount of the solution absorbed in the layers is 3.5-7.0 ml per 1 g of hydrophilic colloid; and the support is a paper support which is coated with polyolefin resin on both sides and which has a water content of 5.5-7.5%.

DESCRIPTION OF THE INVENTION

The present invention will be explained in detail.

Preferred construction of the photosensitive material for diffusion transfer of the present invention comprises a polyolefin resin coated paper support (hereinafter referred to as "RC paper") and, provided thereon, at least an antihalation undercoat layer and a silver halide emulsion layer as disclosed in U.S. Pat. No. 4,302,526.

It is preferred that the silver halide emulsion layer contains 1.5-3 g/m$^2$ of silver halide in terms of silver nitrate and 1-3 g/m$^2$ of hydrophilic colloid and the undercoat layer contains 2-6 g/m$^2$ of hydrophilic colloid.

A negative material superior especially in image reproducibility and running processing characteristics can be obtained by adjusting total hydrophilic colloid amount in the layer on silver halide emulsion layer side of the support to 5-8 g/m$^2$.

If necessary, the material may have a protective layer, a releasing layer, an interlayer, etc.

The hydroxybenzene developing agent used in the present invention includes, for example, hydroquinones such as hydroquinone, methylhydroquinone and chlorohydroquinone, and polyhydroxybenzene compounds such as catechol and pyrogallol. It is preferred to use the hydroxybenzene developing agent in combination with pyrazolidone developing agents such as 1-phenyl-3-pyrazolidone, 5-methyl-1-phenyl-3-pyrazolidone, 1-(3-tolyl)-3-pyrazolidone, and 4,4 dimethyl-1-phenyl-3-pyrazolidone.

Content of the hydroxybenzene developing agent is generally 0.3–3 g/m$^2$, preferably 0.5–2 g/m$^2$. Especially preferably, the developing agent is contained in an undercoat layer, but a part or the whole thereof may be contained in silver halide emulsion layer.

The 3-pyrazolidones may be contained in an amount of 0.05–0.5 g/m$^2$ in optional layers.

The silver halide emulsion layer and undercoat layer of the negative material and image receiving layer of the positive material according to the present invention contain at least one hydrophilic colloid substances, for example, gelatin, gelatin derivatives such as phthalated gelatin, cellulose derivatives such as carboxymethylcellulose and hydroxymethylcellulose, and hydrophilic polymers such as dextrin, soluble starch, polyvinyl alcohol and polystyrenesulfonic acid.

These hydrophilic colloid layers are hardened with at least one hardener. Examples of the hardener are aldehyde hardeners such as formalin and glyoxal, inorganic hardeners such as chrome alum and potassium alum, and non-aldehyde hardeners such as active halogen type, active olefin type, epoxide type and aziridine type. The active halogen type hardeners include those which are disclosed in Belgian Patent Nos. 579,739 and 598,272, West German Patent No. 1,130,283, West German Patent laid-Open Application No. 1,900,791, U.S. Pat. Nos. 2,169,513, 2,732,303, 2,976,150, 2,976,152, 3,106,468, 3,542,549, 3,549,377, 3,645,743, 3,689,274, and 3,701,664, British Patent Nos. 941,998, 974,723, 990,275, 997,635, 1,022,656, 1,072,008, and 1,167,207, Japanese Patent Kokoku Nos. 39-16928, and 47-33380.

The active olefin type hardeners include those which are disclosed in West German Patent Nos. 872,153, 1,090,427, 1,100,942, 1,105,272, and 1,622,260, U.S. Pat. Nos. 2,579,871, 3,255,000, 3,490,911, 3,640,720, 3,642,486, 3,687,707, and 3,749,573, British Patent Nos. 994,869, 1,054,123, 1,115,164, 1,158,263, 1,182,389, and 1,183,648, Japanese Patent Kokoku Nos. 44-23238, 47-8736, and 47-25373.

The epoxide type hardeners include those which are disclosed in Belgian Patent No. 578,751, West German Patent Nos. 1,085,663, 1,091,322, and 1,095,113, U.S. Pat. Nos. 2,726,162, 3,047,394, 3,091,513, and 3,179,517, and Japanese Patent Kokoku No. 34-7133.

The aziridine type hardners include those which are disclosed in Belgian Patent No. 575,440, West German Patent No. 1,081,169, U.S. Pat. Nos. 2,327,760, 2,390,165, 2,950,197, 2,964,404, 2,983,611, 3,017,280, 3,220,848, and 3,549,378, British Patent No. 797,321, Italian Patent No. 572,862, Japanese Patent Kokoku Nos. 33-4212, and 37-8790.

Amount of hardener used may be changed within the range of about 0.01–1.0 mmol per 1 g of gelatin.

In order that the negative material of the present invention can stably provide excellent characteristics even after a long term storage from preparation of the material, it is especially preferred to use nonaldehyde type hardeners.

The above-mentioned kind and amount of the hardeners are one of main factors which govern the amount of absorbed solution on the silver halide emulsion side, although the amount of absorbed solution is also influenced by amount and kind of gelation (for example, lime treated gelatin, acid treated gelatin, low calcium content gelatin as disclosed in U.S. Pat. No. 4,605,609), pH of layers, content of hydroxybenzene developing agent, additives, coating and drying conditions, and heating conditions of coat.

The negative material of the present invention is adjusted so that when the hydrophilic colloid layers on the silver halide emulsion layer side are immersed in a 0.1N aqueous sodium hydroxide solution at 20° C. for 1 minute, amount of the solution absorbed in the layers is within the range of 3.5–7 ml, preferably 4–6 ml per 1 g of hydrophilic colloid. It has been found that if the amount of absorbed solution is less than this range, especially reduction of transfer density or reduction of contrast are liable to occur with use of exhausted processing solution and if the amount is more than this range, image reproducibility is apt to decrease.

Besides, the amount of the absorbed solution within the above range has close relation with water content of RC paper and by adjusting the water content of RC paper to 5.5–7.5%, preferably 6–7%, the amount of the absorbed solution can be assuredly maintained within the above range for a long period of storage after preparation of the negative material. If the water content is outside this range, it is extremely difficult to adjust the amount of the absorbed solution of the negative material to the above range or even if adjustment can be made, the amount of the absorbed solution is outside the range when the negative material is stored and the above-mentioned defects are caused.

Paper substrate of RC paper used for the negative material of the present invention may either comprise wood pulp or contain polyolefin synthetic pulp prepared by making polyethylene, polypropylene, etc. into fine fibrous form as disclosed in Japanese Patent Kokoku No. 40-28125 and Japanese Patent Kokai No. 46-3906. Furthermore, it may contain sizing agents such as rosin, wax, higher fatty acid, petroleum based synthetic sizing agent and other additives (such as dye, fluorescent agent, paper strength increasing agent).

However, it is preferred that paper substrate of RC paper does not contain paper strength increasing agent such as melamine-formaldehyde resin which releases aldehyde. The paper substrate used normally has a basis weight of about 50–200 g/m$^2$.

As polyolefin coat of RC paper, there may be used homopolymers of $\alpha$-olefins having 2–8 carbon atoms such as polyethylene, polypropylene, polybutene, and poly-3-methylbutene and copolymers containing ethylene, propylene or butene such as ethylene-vinyl acetate copolymer, propylene-vinylidene chloride copolymer and propylene-maleic anhydride copolymer. The polyolefin coat may contain, if necessary, inorganic pigments such as titanium oxide, zinc oxide, talc, clay, calcium carbonate, silica, alumina, magnesium oxide, zirconium oxide, lithopone, white lead, and terra alba singly or in combination of two or more at an optional proportion. Filling amount thereof is about 5–30% by weight. In order to increase dispersibility of these pigments in polyolefin, the polyolefin coat may further contain various surface active agents, dispersing agents comprising higher fatty acids or salts thereof, fluorescent brightening agents, antistatic agents, antioxidants, ultraviolet absorbers, and antifoggants as disclosed in Japanese Patent Kokai No. 49-102330. Thickness of polyolefin coat is normally about 10–100 microns, especially about 15–50 microns.

The surface of RC paper may be any of mirror surface, regularly rugged surface and the like.

The polyolefin coat is most generally a polyethylene coat. Material of polyethylene coat can be classified into three of high-pressure polyethylene, medium-pressure polyethylene and low-pressure polyethylene depending on difference of production process and any of these polyethylenes may be used. However, for example, polyethylene used for polyethylene coat on the side on which photographic layers such as silver halide emulsion layer (front side) is a high-pressure polyethylene having a low density of about 0.90–0.94 g/m$^3$ and polyethylene used for the polyethylene coat on the opposite side (back side) is a medium-pressure polyethylene or low-pressure polyethylene having high density alone or as a mixture with a high-pressure polyethylene. Moisture permeability of the polyethylene coat on the front side variously changes depending on material of polyethylene used, additives contained in the coat such as inorganic pigment as mentioned above, thickness of the coat, etc., but is generally about 5–25 g/m$^2$ measured at 30°±1° C. in accordance with JIS Z0208 (Test method for moisture permeability of moistureproof packaging materials).

Water content of RC paper can be adjusted, for example, by the following methods. In making substrate paper of polyolefin coated paper, drying by dryer is controlled or a moisture conditioning zone is provided after completion of drying, thereby to adjust the water content to 5.5–7.5%; A substrate paper made with addition of a deliquescent or moisture absorbing salt (such as calcium chloride) is coated with polyolefin on both sides to obtain RC paper of 5.5–7.5% in water content; An RC paper made by ordinary method without using any of the above means is left to stand in high-humidity atmosphere or exposed to steam to adjust the water content.

"Water content" here is obtained in the following manner: First, weight of an RC paper of a given size is measured to obtain W. Then, absolute dry weight of this RC paper is measured to obtain $W_0$. Water content is obtained from the resulting weights W and $W_0$ in accordance with following formula.

$$\text{Water content (\%)} = \frac{W - W_0}{W} \times 100$$

Silver halide used in the present invention may be anyones, for example, silver chloride, silver bromide, silver chlorobromide or such silver halide combined with silver iodide.

Silver halide used in the present invention is preferably silver chlorobromide or silver chloroiodobromide containing 1–4 mol% of bromide.

If the bromide is less than 1 mol%, density of resulting image is low and if it is more than 4 mol%, the resulting photosensitive material is inferior in running processing characteristics and reduction of image density or reduction of contrast is apt to occur with use of exhausted processing solution.

In the present invention, pH of silver halide emulsion and undercoat layer is preferably 4.5 or less and with use of such pH, a diffusion transfer material which is excellent in stability with lapse of time (shelf stability) and provides image less in unevenness in dots can be obtained.

Silver halide emulsion may also be subjected to spectral sensitization of blue, green and red. This can be attained by adding sensitizing dyes such as merocyanine, cyanine dye, etc.

Furthermore, silver halide emulsion may be subjected to chemical sensitization with various sensitizers such as sulfur sensitizers (e.g., hypo, thiourea, gelatin containing unstable sulfur), noble metal sensitizers (e.g., gold chloride, gold thiocyanate, ammonium chloroplatinate, silver nitrate, silver chloride, palladium salts, rhodium salts, iridium salts, and ruthenium salts), polyalkylene polyamine compounds mentioned in U.S. Pat, No. 2,518,698, iminoamino-methanesulfinic acid mentioned in German Patent No. 1,020,864, and reduction stabilizers (e.g., stannous chloride).

A backing layer which is desirably provided on back side of RC support contains hydrophilic colloid in an amount necessary to keep curling balance with the photosensitive layer side. This amount depends on total amount of hydrophilic colloid on the photosensitive layer side and amount of inorganic white pigment.

The silver halide emulsion layer in the present invention can be improved in image reproducibility when used in combination with an antihalation undercoat layer containing a black pigment.

Further, the silver halide emulsion layer can also be improved in image reproducibility when used in combination with an antihalation undercoat layer containing a white pigment.

The image reproducibility can also be improved by using an antihalation layer containing a black pigment and a white pigment in combination.

The constituting elements of the diffusion transfer material of the present invention may further contain various additives.

Examples of these additives are antifoggants and stabilizers such as mercapto compounds and tetrazaidene, surface active agents such as anionic compounds, e.g., saponin, sodium alkylbenzenesulfonate, sulfosuccinate esters, and alkylarylsulfonates as mentioned in U.S. Pat. No. 2,600,831 and amphoteric compounds as mentioned in U.S. Pat. No. 3,133,816, wetting agents such as wax, polyol compounds, glyceride of higher fatty acids, and higher alcohol esters, mordants such as N-guanylhydrazone compounds, quaternary onium compounds and tertiary amine compounds, antifoggants such as diacetylcellulose, styrene-perfluoroalkylenesodium maleate copolymer, and alkali salts of reaction product of styrene-maleic anhydride copolymer and p-aminobenzenesulfonic acid, matting agents such as polymethacrylate esters, polystyrene, and colloidal silica, film property modifiers such as acrylate esters and various latexes, thickening agents such as styrenemaleic acid copolymer and that mentioned in Japanese Patent Kokoku No. 36-21574, antioxidants, developing agents, and pH adjustors.

A plurality of the hydrophilic colloid layers can be coated separately or simultaneously. Coating method may be any of known methods.

Processing solution used for diffusion transfer process may contain alkaline materials such as sodium hydroxide, potassium hydroxide, lithium hydroxide, and tribasic sodium phosphate; silver halide solvents such as sodium thiosulfate, ammonium thiocyanate, cyclic imide compounds, and thiosalicylic acid; preservatives such as sodium sulfite; thickening agents such as hydroxyethyl cellulose and carboxymethyl cellulose; antifoggants such as potassium bromide and 1-phenyl-5-mercaptotetrazole; development modifiers such as polyoxyalkylene compounds and onium compounds; developing agents such as hydroquinone and 1-phenyl-3-pyrazolidone; and alkanol amines.

The present invention will be illustrated by the following nonlimiting examples.

EXAMPLE 1

An aqueous solution of sodium chloride and potassium bromide and an aqueous solution of silver nitrate were simultaneously added at a rate of 5 ml/min to an aqueous solution of inert gelatin kept at 60° C. with vigorous stirring to obtain a silver chlorobromide emulsion containing 2% of bromide. The silver halide grains were in cubic form in habit and had an average particle size of 0.32μ and 90% by weight or more of the total grains were included within ±30% of the average grain size.

The emulsion was precipitated and washed with water and redissolved and then was subjected to sulfur sensitization and gold sensitization with sodium thiosulfate and potassium chloroaurate. To the resulting emulsion was added a sensitizing dye to carry out orthochromatic sensitization and a surface active agent was added thereto to make up emulsion.

On one side of a paper support of 110 g/m$^2$ coated with polyethylene on both sides was provided an undercoat layer comprising 4 g/m$^2$ of gelatin containing 0.5 g/m$^2$ of carbon black, 0.8 g/m$^2$ of hydroquinone and 0.2 g/m$^2$ of 1-phenyl-4,4-dimethyl-3-pyrazolidone as an antihalation layer and on this undercoat layer was provided an emulsion layer comprising the above obtained emulsion so that amount of coated silver was 1.3 g/m$^2$, amount of coated gelatin was 2.0 g/m$^2$ and amount of hydroquinone was 0.3 g/m$^2$.

The undercoat layer and the emulsion layer both had a pH of 4.0. On the opposite side (back side) of the support was provided a gelatin layer (containing silica particles) necessary to control curling and having a pH of 4.5.

After drying, the samples were heated for 6 days under the conditions of 35° C. RH 60%.

All of the gelatin layers contained 2,4-dichloro-6-hydroxy-S-triazine (Na salt) as a hardener. Amount of the hardener was changed so that when the sample after the heating referred to above was immersed in a 0.1N aqueous NaOH solution at 20° C. for 1 minute, amount of the solution absorbed by the undercoat layer an the emulsion layer became the value (±5%) as shown in the following table. Water content of RC paper was as shown in the following table. Thus, Samples A-L were prepared.

| | Amount of Absorbed solution (ml) | | | |
|---|---|---|---|---|
| Water content of RC (%) | 3 | 4.5 | 6 | 7.5 |
| 4.5 | A | B | C | D |
| 6.5 | E | F | G | H |
| 8.5 | I | J | K | L |

A part of these samples were stored for 7 days under the conditions of 50° C. RH 80%.

These samples were exposed through a wedge differing stepwise in density by 0.05 each. These samples were brought into close contact with image receiving material MITSUBISHI ONE STEP PC and were passed through a conventional processor having the following diffusion transfer processing solution and after 60 seconds, these were separated from each other. Processing temperature was 25° C. Diffusion transfer processing solution.

| | |
|---|---|
| EDTA | 1 g |
| Anhydrous sodium sulfite | 60 g |
| Sodium thiosulfate ($5H_2O$) | 15 g |
| KBr | 1 g |
| 1-Phenyl-5-mercaptotetrazole | 0.05 g |
| N-methylethanolamine | 40 ml |
| N-methyldiethanolamine | 40 ml |
| Water to make up 1 liter | |

Separately, using ARTGRAPHICA 601 II manufactured by Dainippon Screen Mfg. Co., Ltd. as a process camera, an original comprising fine lines having width of 10μ, 20μ, 30μ, - - - , 100μ in equal difference of 10μ was photographed on Samples A-L, followed by subjecting them to the same processing as above to obtain fine line images.

The results are shown in Table 1.

In Table 1, $D_T$ means transmission density and L means difference between a logarithm of relative exposure at (minimum density+0.02) and a logarithm of relative exposure at a density of 2.0.

Fine line reproducibility is expressed by reproducible minimum line width (positive ruled line) (μm).

TABLE 1

| | 35° C., 60% RH 6 days | | | 50° C., 80% RH 7 days | | |
|---|---|---|---|---|---|---|
| Sample | $D_T$ | L | Reproducibility of fine line (μm) | $D_T$ | L | Reproducibility of fine line (μm) |
| A | 3.3 | 0.32 | 28 | 3.1 | 0.35 | 38 |
| B | 3.6 | 0.31 | 28 | 3.4 | 0.32 | 41 |
| C | 3.5 | 0.32 | 31 | 3.4 | 0.32 | 42 |
| D | 3.4 | 0.31 | 32 | 3.4 | 0.32 | 44 |
| E | 3.3 | 0.33 | 28 | 2.6 | 0.37 | 30 |
| F | 3.6 | 0.31 | 29 | 3.5 | 0.32 | 31 |
| G | 3.5 | 0.31 | 30 | 3.4 | 0.32 | 33 |
| H | 3.5 | 0.31 | 33 | 3.4 | 0.32 | 39 |
| I | 3.4 | 0.32 | 28 | 2.1 | 0.43 | 32 |
| J | 3.6 | 0.32 | 30 | 2.4 | 0.42 | 33 |
| K | 3.6 | 0.31 | 31 | 2.6 | 0.40 | 34 |
| L | 3.5 | 0.30 | 31 | 2.9 | 0.38 | 36 |

As can be seen from Table 1, Samples F and G of the present invention were small in change of characteristics even after stored and stably had excellent fine line reproducibility in high density and high contrast.

EXAMPLE 2

Layers were coated on a support having a water content of 4%, 5%, 6%, 7%, 8% or 9% in RC paper in the same manner as in Example 1 except that amount of hardener in all gelatin layers was 7 mg per 1 g of gelatin. Amount of absorbed solution was measured in the same manner as in Example 1 to obtain 5.0±0.2 ml per 1 g of gelatin in all samples. Results of test conducted in the same manner as in Example 1 are shown in Table 2.

TABLE 2

| Sample | Water content of RC (%) | 35° C., 60% RH 6 days DT | L | Reproducibility of fine line (μm) | 50° C., 80% RH 7 days DT | L | Reproducibility of fine line (μm) |
|---|---|---|---|---|---|---|---|
| M | 4 | 3.6 | 0.30 | 32 | 3.5 | 0.31 | 45 |
| N | 5 | 3.5 | 0.31 | 31 | 3.4 | 0.32 | 38 |
| O | 6 | 3.5 | 0.31 | 30 | 3.4 | 0.32 | 32 |
| P | 7 | 3.5 | 0.31 | 30 | 3.3 | 0.33 | 31 |
| Q | 8 | 3.4 | 0.31 | 30 | 2.9 | 0.36 | 32 |
| R | 9 | 3.4 | 0.31 | 30 | 2.4 | 0.40 | 32 |

As can be seen from Table 2, Samples Q and P of the present invention were small in change in characteristics even after stored and stably had excellent fine line reproducibility in high density and high contrast.

EXAMPLE 3

Samples were prepared in the same manner as in Example 1 except that amount of gelatin in antihalation undercoat layer of Sample F was 2 g/m$^2$, 4 g/m$^2$ (Sample F) and 8 g/m$^2$. The samples were tested in the same manner as in Example 1 and the results are shown in Table 3.

TABLE 3

| Sample | Gelatin in undercoat layer (g/m$^2$) | 35° C., 60% RH 6 days DT | L | Reproducibility of fine line (μm) | 50° C., 80% RH 7 days DT | L | Reproducibility of fine line (μm) |
|---|---|---|---|---|---|---|---|
| F | 4 | 3.6 | 0.31 | 29 | 3.5 | 0.32 | 31 |
| F' | 5 | 3.3 | 0.29 | 32 | 3.2 | 0.30 | 35 |
| F'' | 6 | 3.4 | 0.33 | 30 | 3.1 | 0.35 | 33 |

It can be seen from Table 3 that Sample F which had hydrophilic colloid on the emulsion layer side within the range of 5-8 g/m$^2$ was more preferred.

What is claimed is:

1. A silver complex diffusion transfer process for producing images which comprises imagewise exposure to light of a photosensitive material comprising a polyolefin resin coated paper having a water content of 5.5 to 7.5% and provided thereon a water permeable silver halide emulsion layer and a water permeable hydrophilic colloid, layer, wherein at least one of the silver halide emulsion layer and the hydrophilic colloid layer contains a hydroxybenzene developing agent; when the layers on the emulsion layer coated side are immersed in a 0.1N aqueous sodium hydroxide solution at 20° C. for 1 minute, amount of solution absorbed in the layers is 3.5-7.0 ml per 1 g of hydrophilic colloid and developing the exposed material with a processing solution in the presence of a developing agent and a solvent for the silver halide to form a soluble silver complex, and transferring the thus produced imagewise silver complex to an image receiving layer containing physical development nuclei of positive material to form a silver image.

2. The silver complex diffusion transfer process according to claim 1, wherein the photosensitive material has an antihalation undercoat layer between the support and the silver halide emulsion layer.

3. The silver complex diffusion transfer process according to claim 1, wherein the total amount of hydrophilic colloid in the layers on the emulsion layer side is 5-8 g/m$^2$.

4. The silver complex diffusion transfer process according to claim 2, wherein the developing agent is contained in the undercoat layer.

5. The silver complex diffusion transfer process according to claim 1, wherein the layers contain at least one hardener.

6. The silver complex diffusion transfer process according to claim 1, wherein the polyolefin resin coated on the paper is polyethylene.

7. The silver complex diffusion transfer process according to claim 2, wherein the emulsion layer and the undercoat layer have a pH of 4.5 or less.

* * * * *